US010413949B2

(12) United States Patent
Mueller

(10) Patent No.: US 10,413,949 B2
(45) Date of Patent: Sep. 17, 2019

(54) METHOD OF AND APPARATUS FOR ROLLING STRIP OF FLUCTUATING THICKNESS

(71) Applicant: BILSTEIN GmBH & Co. KG, Hagen (DE)

(72) Inventor: Ingolf Guenter Mueller, Olpe (DE)

(73) Assignees: BILSTEIN GMBH & CO. KG, Hagen (DE); TILGERT WALZWERKMASCHINENBAU GMBH, Iserlohn (DE)

( * ) Notice: Subject to any disclaimer, the term of this patent is extended or adjusted under 35 U.S.C. 154(b) by 0 days.

(21) Appl. No.: 15/438,396

(22) Filed: Feb. 21, 2017

(65) Prior Publication Data

US 2017/0239700 A1 Aug. 24, 2017

(30) Foreign Application Priority Data

Feb. 23, 2016 (DE) ..... 10 2016 103 088

(51) Int. Cl.

| | |
|---|---|
| ***B21B 38/10*** | (2006.01) |
| ***B21B 1/22*** | (2006.01) |
| ***B21B 37/26*** | (2006.01) |
| ***B21B 37/50*** | (2006.01) |
| ***B21B 37/54*** | (2006.01) |

(52) U.S. Cl.

CPC ..... *B21B 38/10* (2013.01); *B21B 1/22* (2013.01); *B21B 37/26* (2013.01); *B21B 37/50* (2013.01); *B21B 37/54* (2013.01); *B21B 2261/05* (2013.01); *B21B 2265/08* (2013.01)

(58) Field of Classification Search

CPC ..... B21B 37/26; B21B 37/50; B21B 37/54; B21B 38/10; B21B 2271/02

See application file for complete search history.

(56) References Cited

FOREIGN PATENT DOCUMENTS

| | | | | |
|---|---|---|---|---|
| EP | 1121990 A2 * | 8/2001 | ..... | B21B 37/26 |
| EP | 1908534 A1 * | 4/2008 | ..... | B21B 37/26 |
| JP | 10034204 A * | 2/1998 | ..... | B21B 37/48 |

* cited by examiner

*Primary Examiner* — Debra M Sullivan
(74) *Attorney, Agent, or Firm* — Andrew Wilford

(57) ABSTRACT

An apparatus for rolling strip having a periodically fluctuating strip thickness has a roll stand with a set of rollers defining a gap, an adjustment actuator for adjusting the gap of the set of rollers, unwinder for feeding the strip with an initial thickness to an intake side of the roller gap, winder for receiving the strip with a desired final thickness from an output side of the gap, respective upstream and roller assemblies each having an immersion roller provided upstream of the roll stand between the unwinder and the roll stand and downstream of the roll stand between the roll stand and the winder. The strip is guided around the immersion rollers. A controller sets positions of the immersion rollers while operating the rollers of the roll stand at a constant roller speed, for determining the roller gap in dependence on the setting of the rollers.

8 Claims, 3 Drawing Sheets

METHOD OF AND APPARATUS FOR ROLLING STRIP OF FLUCTUATING THICKNESS

FIELD OF THE INVENTION

The present invention relates to the rolling of strip. More particularly this invention concerns a method of and apparatus for rolling strip of fluctuating thickness.

BACKGROUND OF THE INVENTION

An apparatus for rolling strip having a periodically fluctuating strip thickness has a roll stand with a set of rollers and an adjustment actuator for adjusting the gap of the set of rollers, to which roller gap the strip is fed from an unwinder with an initial thickness on the intake side and from which roller gap the strip is fed with the respective desired final thickness to a winder on the output side with the final thickness being determined by the roller gap.

An apparatus of this type as well as a method of this generic type are known from the prior art. In such an apparatus and method, strip materials made of strip steel are usually processed. One apparatus of this generic type is known particularly from EP 1 121 990. This prior art describes a cost-effective possibility for unwinding under tension strip that has been wound into coils, reducing the strip thickness, and subsequently winding the strip up again under tension, with a relatively constant strip thickness being provided on the intake side and a periodically fluctuating strip thickness being desired on the output side. In that printed publication, this is achieved by providing a compensating or dancer roll between the unwinder and the roll stand as well as between the roll stand and the winder, around which the strip is fed in a loop and which are force-controlled at a constant circumferential speed by the rollers of the roll stand, which determine the roller gap, in order to set the desired strip tension. It is also necessary for the winder and unwinder to be speed-controlled.

While this proposed apparatus is usable in principle, the force control of the compensating or dancer rolls in particular is only possible with a relatively large investment of time, with the consequence that rolling defects resulting from the periodically fluctuating strip thickness cannot be compensated for quickly enough. This means that strips of periodically fluctuating thickness produced with the apparatus are faulty due to the high travel speed.

The speed control of the winder and unwinder is also laborious and can also lead to faults during the operation of the corresponding apparatus.

OBJECTS OF THE INVENTION

It is therefore an object of the present invention to provide an improved method of and apparatus for rolling strip of variable thickness.

Another object is the provision of such an improved method of and apparatus for rolling strip of variable thickness that overcomes the above-given disadvantages, in particular that does not make use of the features of controlling the force of a compensating or dancer roll and controlling the speed of the winder and unwinder and enables faster automatic adjustment of the roller gap at high throughput speeds and thus a high level of quality on the part of the periodically fluctuating strip, particularly in consideration of the different strip speeds on the intake and output sides of the roller gap.

SUMMARY OF THE INVENTION

An apparatus for rolling strip having a periodically fluctuating strip thickness has according to the invention a roll stand with a set of rollers defining a gap, an adjustment actuator for adjusting the gap of the set of rollers, unwinder for feeding the strip with an initial thickness to an intake side of the roller gap, winder for receiving the strip with a desired final thickness from an output side of the gap, respective upstream and roller assemblies each having an immersion roller provided upstream of the roll stand between the unwinder and the roll stand and downstream of the roll stand between the roll stand and the winder. The strip is guided around the immersion rollers, control means for setting positions of the immersion rollers while operating the rollers of the roll stand at a constant roller speed, for determining the roller gap in dependence on the setting of the rollers and thereby compensating for changes in the speed of the rolled material on the intake and output sides of the roll stand, and for operating the unwinder and the winder in a tension-controlled manner.

In other words, the invention proposes that a roller assembly with an immersion roller be disposed both between the unwinder and the roll stand and between the roll stand and the winder around which the strip is guided, and that the immersion rollers be position-controlled at a constant roller speed by the rollers of the roll stand determining the roller gap in dependence on the setting of the rollers, thereby compensating for the changes in the speed of the rolled material on the intake and output sides of the roll stand, and that the unwinder and the winder be operated in a tension-controlled manner.

According to the invention, the immersion rollers are position-controlled directly by the setting of the roller gap, which results in substantially faster adjustment as the roller gaps change and to a precise compaction result. What is more, both the unwinder and the winder are operated in a tension-controlled manner, which is especially advantageous for the use of the apparatus.

In addition, a respective support roller for the strip is provided upstream of each immersion roller and downstream of each immersion roller over which the strip is guided, and each support roller has a strip-length and/or a strip-speed detector.

By virtue of such an arrangement and design, it is possible to control the position of the immersion rollers not only as a function of the setting of the roller gap, but rather the strip length produced and the strip speed is also taken into account during the adjusting of the immersion roller. This leads to an even better result in terms of the rolling process.

In addition, the unwinder and the winder are provided with a tension-measuring device that controls the power supplies to the drive motors of the winder and unwinder.

In particular, a controller detects the setting of the rollers for a predeterminable roller gap and positions the immersion rollers as a function thereof.

In addition, the rollers of the roll stand determining the roller gap rotate at a constant speed.

A method according to the invention is characterized in that a roller assembly with an immersion roller that can be adjusted transversely to the direction of travel of the strip and around which the strip is guided is disposed both between the unwinder and the roll stand and between the roll stand and the winder, with the immersion rollers being position-controlled in dependence on the setting of the rollers of the roll stand, so that changes in the speed of the rolled material on the intake side and on the output side of the roll stand are compensated for by the change in position, and that the unwinder and the winder are operated in a tension-controlled manner.

The strip length and the speed of the strip passing through are detected upstream of and downstream of each immersion roller and fed to a control for the roller system, and signals for position detection and/or correction of the position of the immersion rollers are generated from the collected data.

Furthermore, for adjusting the tension of the winder and unwinder, the tensile forces of the winder and unwinder are detected and the collected data are fed to a control apparatus by means of which the power supply to the drive systems of the winder and unwinder is controlled such that the reel tension is adapted to the respective requirements from the operating parameters.

The setting of the rollers is detected for a predetermined roller gap and is fed as signals to a control apparatus that moves the immersion rollers through a target movement associated with the roller gap that is stored in the control as a data pattern.

Moreover, the rollers of the roll stand determining the roller gap are operated at a constant speed.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
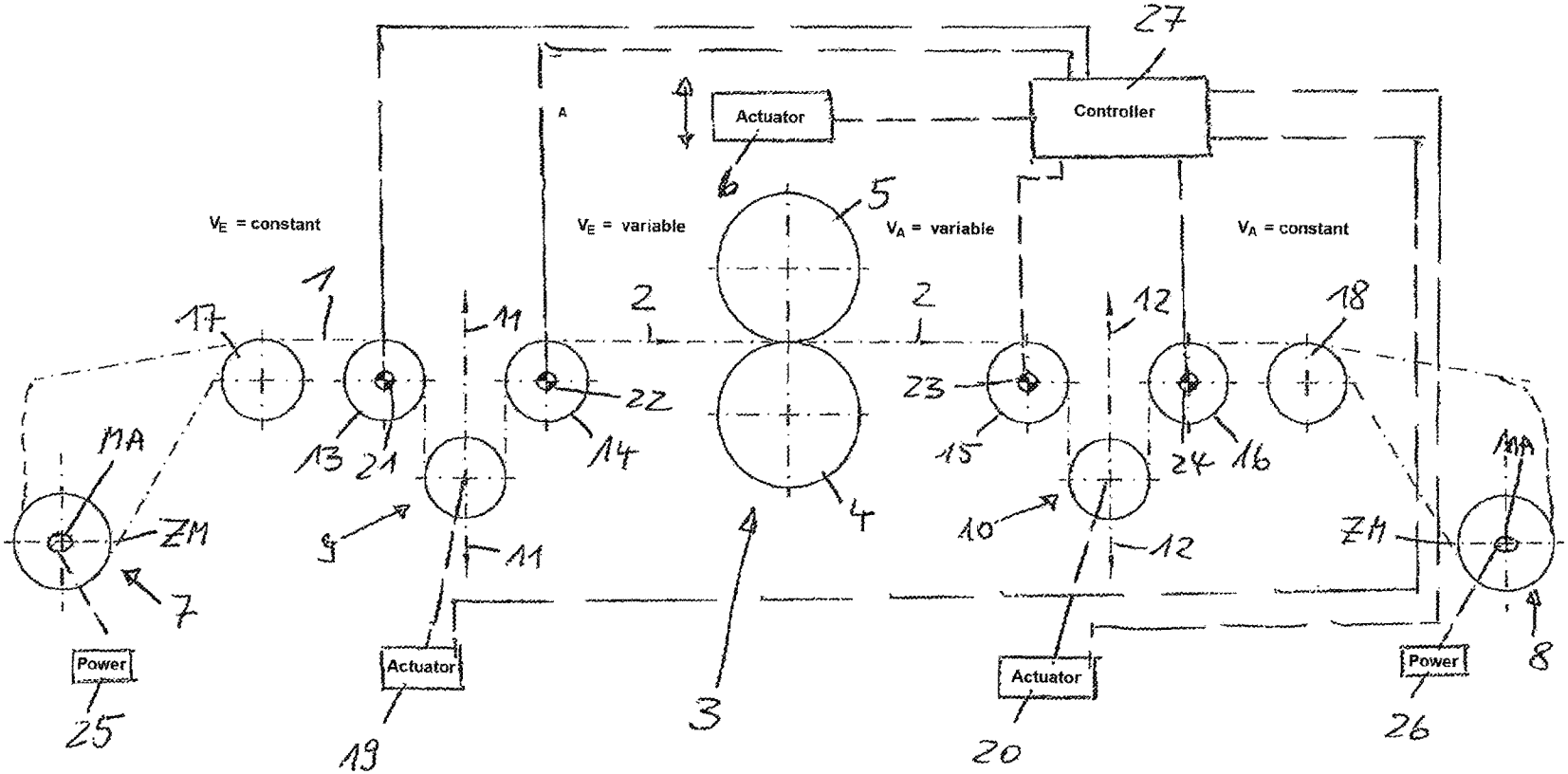
FIG. 1 is a schematic side view of the apparatus according to the invention.

As seen in FIG. 1 an apparatus according to the invention for rolling strip 1 having a periodically fluctuating strip thickness and moving in a travel direction 2. The apparatus comprises a roll stand 3 whose essential parts are shown—namely, a set of two rollers 4 and 5. Furthermore, an adjustment actuator 6 is shown schematically that serves to adjust the gap of the rollers 4 and 5.

Figure 2:
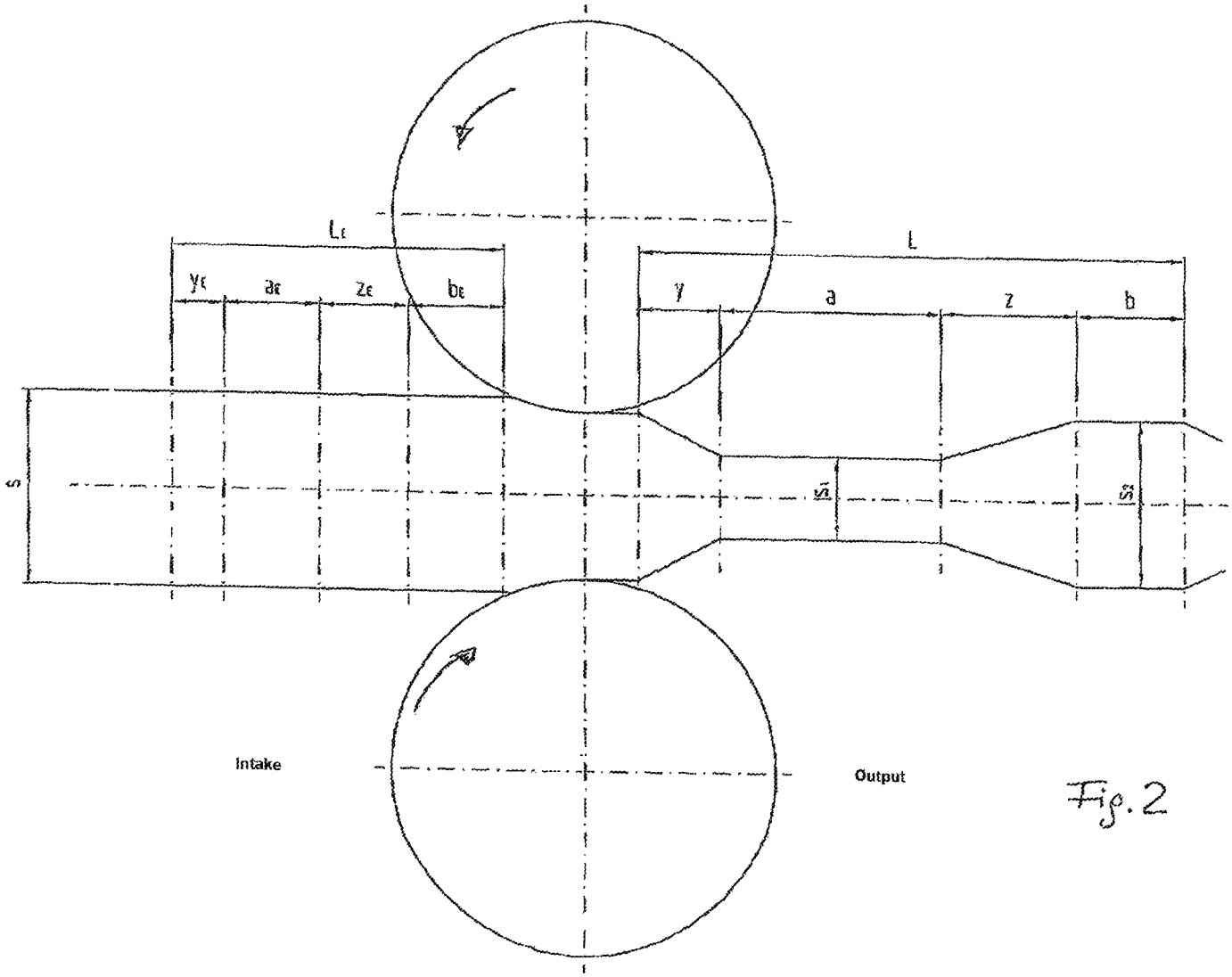
FIG. 2 is a detail view of the invention.
Figure 3:
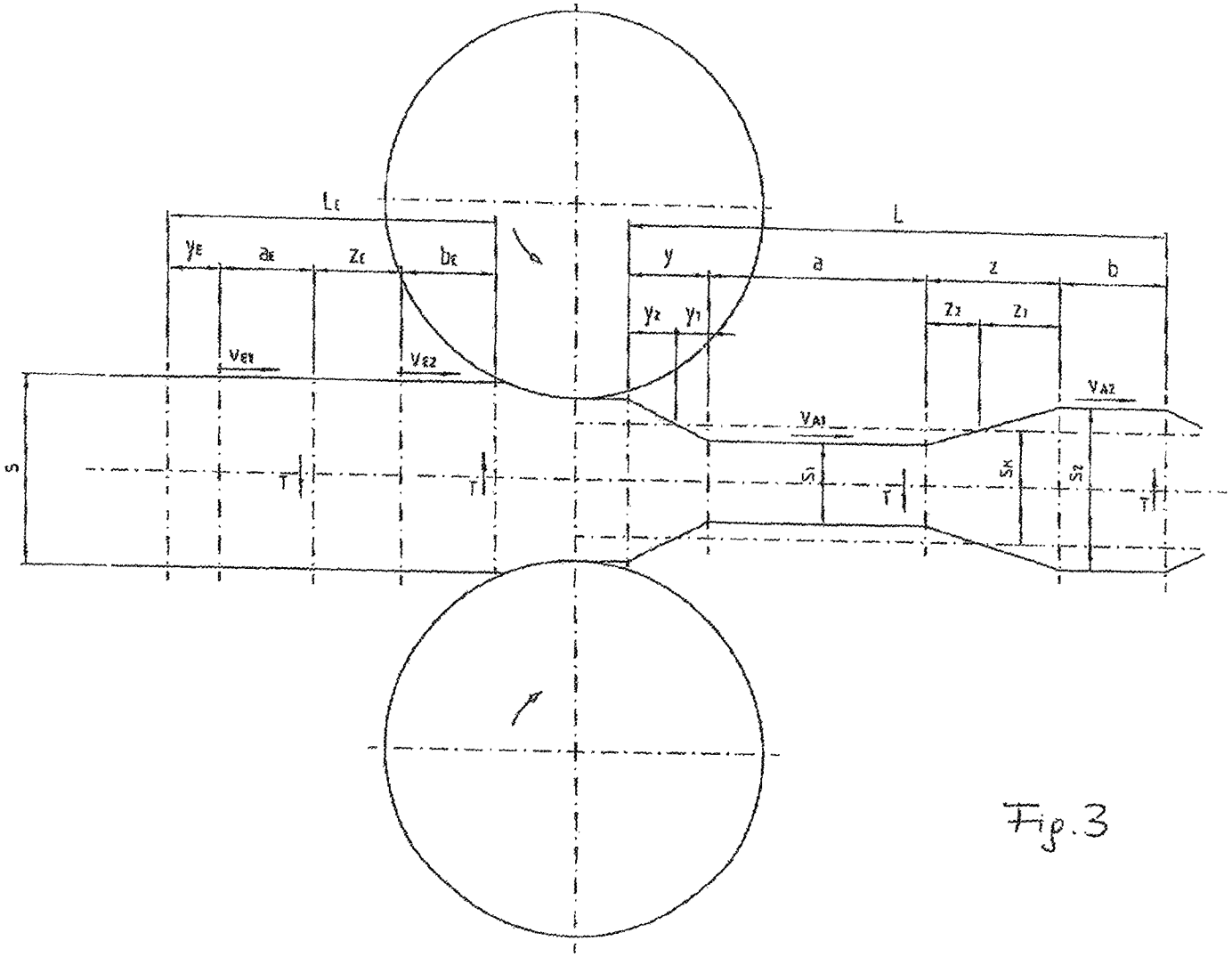
FIG. 3 is another detail view of the invention.

The roller gap, which can be seen particularly well in FIGS. 2 and 3, is set according to the desired strip thickness to be produced. The strip 1 having an initial thickness is fed to the roller gap from an unwinder 7, and from there the strip 1 having the respective desired final thickness is fed on the output side to a winder 8. Roller assemblies each with at least one respective immersion roller 9, 10 are provided both between the unwinder 7 and the roll stand 3 and between the roll stand 3 and the winder 8. Pairs of guide rollers 13, 14 and 15, 16 flank the immersion rollers 9 and 10 that can be moved as shown by the arrows 11 and 12 toward and away from a plane defined by the rotation axes of the respective guide rollers 13, 14, 15, and 16. An additional guide and deflection roller 17 is provided between of the upstream guide roller 13 and the unwinder 7 and another guide and deflection roller 18 is between the guide roller 16 and the winder 8. The strip 1 passing through is thus guided sequentially around the rollers 17, 13, 9, 14 and 15, 10, 16, and 18, in that order.

The immersion rollers 9 and 10 can be adjusted up and down as shown in the drawing plane by respective actuators 19 and 20 in the direction of the movement arrows 11 and 12 and are position-controlled in dependence on the setting of the rollers 4, 5 at a constant speed by the rollers 4, 5 of the roll stand 3 determining the roller gap in order to compensate for changes in the speed of the rolled material, i.e., the strip 1, on the intake side and on the output side of the roll stand 3. The unwinder 7 and the winder 8 are operated to control tension in the strip 1.

The support rollers 13, 14, 15, 16 that flank the immersion rollers 9 and 10 and over which the strip 1 is guided each have respective strip-length and strip-speed detectors 21, 22, 23, 24. Furthermore, the unwinder 7 and the winder 8 are each provided with a tension-measuring devices ZM that control power supplies 25, 26 of drive motors MA of the unwinder and winder 7, 8 in order to maintain the reel tension according to the requirements from the operating parameters.

Moreover, a controller 27 is provided that detects, processes and/or stores the set point for setting the rollers 4, 5 for a predeterminable roller gap and that controls the positions of the immersion rollers 9, 10 as a function thereof. For this purpose, the controller 27 communicates with the adjustment actuator 6, with the length and speed detectors 21, 22, 23, 24, and with the actuators 19, 20 for the immersion rollers 9, 10, so that the setting of the rollers 4, 5 for the predetermined roller gap is detected by the controller 27 and the immersion rollers 9, 10 are position-controlled as a function thereof.

The rollers 4, 5 of the roll stand 3 determining the roller gap are operated at a constant speed. In FIG. 1 of the drawing, the regions of constant speed of the strip 1 and variable speed of the strip 1 on the intake side and on the output side are designated by $v_E$=constant, $v_E$=variable, $v_A$=variable, and $v_A$=constant.

The entire region from the unwinder 7 to the roll stand 3 is referred to as the intake zone, and the region from the roll stand 3 to the winder 8 as the output zone.

The changes in the speed of the rolled material (strip 1) on the intake and output sides of the roll stand 3 resulting from the periodically fluctuating strip thicknesses at constant roller speed are compensated for by movement of the two immersion rollers 9 and 10. The immersion rollers 9, 10 are position-controlled. The control occurs directly by positioning the rollers 4, 5 in conjunction with signals for the rolled strip length. The two reels 7 and 8 are operated in a tension-controlled manner.

The aim is to determine the movement of the immersion rollers 9, 10 directly from the operating parameters of the rolling process. In this way, the direction of movement and the type of movement (constant speed, acceleration, or deceleration) of the immersion rollers 9, 10 is determined by the profile of the rolled material.

As for controlling movement of the immersion rollers, this is derived directly from the signals for the setting of the rollers as well as from the strip length signals that are detected by the detectors 21, 22, 23, 24.

The movement of the immersion rollers 8, 10 is periodic. Each period of the immersion rollers 9, 10 at the intake and output is time-correlated exactly to a rolling period.

As shown in FIGS. 2 and 3, in order to ensure that a movement T of the immersion rollers 9, 10 is correlated with precision, the profile of the rolled material of a rolling period L is subdivided into segments. The individual segments each comprise regions of constant strip thickness (a with $s_1$ and b with $s_2$) and of variable strip thickness (Y and Z). By determining the individual cross sections, a cross-sectionally identical and hence mass-equivalent segment is ensured at the roller intake ($a_E$ and $b_E$ as well as $y_E$ and $z_E$ with initial strip thickness s). From this, for a rolling period L, one obtains the mass-equivalent strip length on the intake side $L_E$.

One can calculate the average strip thickness $s_M$ on the output side from the individual segments of a rolling period. This average strip thickness is an equivalent for the average speed at the roller output ($V_{AM}$) and thus also determines the average speed on the intake side ($V_{EM}$). The reel speeds on the intake and output side then each correspond to these average speeds, as if the incoming strip having the thickness s were rolled to the thickness $s_M$ under constant conditions.

This segment-by-segment manner of viewing the relationships between the average strip thickness and the thickness in a segment enables inferences to be made with respect to the respective speed ratio. The greater the differences in thickness are, the greater the difference in speed in this segment of the roller output is.

For the roller intake as well, the movements of the roller setting and hence the rolling profile are also crucial for the current speed. Given a constant roller speed and consistent tensions, the intake speed is greater in the case of a low reduction ratio than with a high reduction ratio. Cross-sectionally identical segments in the roller intake can always be correlated with the segments in the output. From the segments of a complete period, it is then possible to determine both an average speed on the intake side and the movement of the immersion rollers 9, 10 on a segment-by-segment basis.

The type and direction of the immersion roller movements 11, 12 (constant speed up/down, deceleration, dead center, or acceleration) can thus be derived from the rolling parameters. In order to precisely correlate the movement of the immersion rollers 9, 10 to the rolling process, the outgoing rolling profile of a period L is compared on a segment-by-segment basis with a portion of equal volume and length L having the average thickness $s_M$.

With the thickness $s_2$, the segment b is thicker than the average thickness $s_M$. This means that the speed of the outgoing strip $v_{A2}$ is less than the average speed $v_{AM}$. To compensate for this, a constant upward movement of the immersion roller is required. The segment Z is divided into two portions ($Z_1$ and $Z_2$) by crossing the thickness of the rolled profile with the average thickness. In the region $Z_1$, the thickness is reduced until it reaches the average thickness. This means that the speed of the outgoing strip is accelerated up to the average speed $v_{AM}$. At the point of intersection, the average speed and the speed of the outgoing strip are identical. For the immersion roller, this means that the upward movement of the immersion roller is slowed, and the roller reaches top dead center at the point of intersection. In the region $Z_2$, the thickness is further reduced until it reaches the thickness $s_1$. The speed of the outgoing strip is accelerated until it reaches the speed $v_{A1}$. The immersion roller is accelerated downward in this region.

With the thickness $s_1$, the segment a is thinner than the average thickness $s_M$. The speed of the outgoing strip $v_{A1}$ is therefore greater than the average speed $v_{AM}$. The immersion roller compensates for this through a constant downward movement.

For the segment Y, it holds that the speed of the outgoing strip is reduced until the speed $v_{A2}$ is reached. In the region $Y_1$, the downward movement is slowed until bottom dead center is reached, and, in the region $Y_2$, the immersion roller is accelerated upward again. The control of the movement of the immersion rollers at the output follows the control of the immersion rollers at the intake.

In the segment $b_E$, the speed of the incoming strip $v_{E2}$ is greater than the average speed, and in segment $a_E$, the speed $v_{E1}$ is lower.

Movement of the immersion rollers compensates for this and, at constant speed, is moved up in the segment $b_E$ and down in the segment $a_E$. The segments $Z_E$ and $Y_E$ are also characterized by slowing, dead center, and acceleration. The points at dead center are each controlled isochronously with the output-side points at dead center.

In order to monitor and, as appropriate, correct the movements of the immersion rollers, the rollers are provided with pulse generators for detecting strip length and monitoring speed before approaching and after leaving an immersion roller.

The signals for movement of the immersion roller can thus be coordinated with precision with the roller setting and hence to the rolling profile.

Corrections can become necessary, for example, if the influence of the roller diameters becomes so great in the case of very fast changes in the roller setting that the material fractions that are additionally blocked or released influence movement of the immersion rollers or if deviations in the thickness of the strip influence the rolling process.

Since movement of the immersion rollers can be adapted very precisely to the roller setting and hence to the respective change in profile, a constant winding speed and therefore an exact tension control for both reels poses no difficulty.

It remains to be noted that the processes shown in the illustrated embodiment are only an example. More than four segments for a rolling period are also possible.

The invention is not limited to the illustrated embodiments, but rather can be varied in many respects within the framework of the disclosure.

All of the individual and combined features disclosed in the description and/or drawing are regarded as being essential to the invention

I claim:

1. An apparatus for rolling strip having a periodically fluctuating strip thickness, the apparatus comprising:

a roll stand with a set of rollers defining a gap;

an adjustment actuator for adjusting the gap of the set of rollers;

unwinding means for feeding the strip with an initial thickness in a travel direction to an intake side of the roller gap;

winding means for receiving the strip with a desired final thickness from an output side of the gap;

an upstream roller assembly having a respective immersion roller and upstream of the roll stand between the unwinding means and the roll stand;

a downstream roller assembly having a respective immersion roller and downstream of the roll stand between the roll stand and the winding means, the strip being guided around the respective immersion rollers on each side of the roll stand; and control means for, while operating the rollers of the roll stand at a constant roller speed, determining the roller gap in dependence on the relative positions of the rollers of the roll stand and setting positions of the immersion rollers directly according to the detected positions of the rollers of the roll stand, and for operating the unwinding means and the winding means in a tension-controlled manner.

2. The apparatus defined in claim 1, further comprising:

a respective support roller for the strip upstream of each immersion roller and downstream of each immersion roller over which the strip is guided, each support roller having a strip-length or strip-speed detector.

3. The apparatus defined in claim 1, wherein the unwinding means and the winding means are each provided with a respective tension-measuring device controlling a respective power supply of motors of the winding and unwinding means.

4. A method of operating an apparatus for rolling strip having a periodically fluctuating strip thickness, the apparatus having:

a roll stand with a set of relatively movable rollers defining a gap;

an adjustment actuator for adjusting the gap of the set of rollers;

unwinding means for feeding the strip in a travel direction with an initial thickness to an intake side of the roller gap; and winding means for receiving the strip with a desired final thickness from an output side of the gap, the method comprising the steps of:

determining the final thickness by the roller gap;

providing upstream and downstream roller assemblies each with a respective immersion roller that can be adjusted transversely to the travel direction of the strip and around which the strip is guided both upstream of the roll stand between the unwinding means and the roll stand and downstream of the roll stand between the roll stand and the winding means;

detecting the relative positions of the rollers of the roll stand; and directly controlling with a controller positions of the immersion rollers in dependence on the detected positions of the rollers of the roll stand, while operating the unwinding means and the winding means in a tension-controlled manner.

5. The method defined in claim 4, further comprising the step of:

detecting upstream and downstream lengths and speeds of the strip upstream and downstream of each immersion roller;

feeding an output corresponding thereto to the controller for the roller system; and the controller, based on the outputs, correcting positions of the immersion rollers.

6. The method defined in claim 4, further comprising the steps, for operating the winding and unwinding means in the tension-controlled manner, of:

detecting tensile forces of the winding and unwinding means and feeding outputs corresponding thereto to the controller; and the controller operating respective power supplies of the winding and unwinding means such that strip tension is adapted to requirements from operating parameters.

7. The method defined in claim 4, further comprising the steps of:

detecting a position of the rollers of the roll stand for a predetermined roller gap and feeding signals corresponding thereto to the controller; and the controller moving the immersion rollers to a target position associated with the position of the roller gap that is stored in the control as a data pattern.

8. The method defined in claim 4, further comprising the step of:

operating the rollers of the roll stand at a constant speed.

* * * * *